US005910402A

United States Patent [19]

De Keyzer et al.

[11] Patent Number: 5,910,402

[45] Date of Patent: Jun. 8, 1999

[54] PHOTOSENSITIVE IMAGE-FORMING ELEMENT WITH INCREASED SENSITIVITY-FOG-RELATIONSHIP

[75] Inventors: René De Keyzer, Waasmunster; Johan Loccufier, Zwijnaarde; Kathy Elst, Kessel, all of Belgium

[73] Assignee: AGFA-Gevaert, N.V., Mortsel, Belgium

[21] Appl. No.: 09/084,218

[22] Filed: May 26, 1998

[30] Foreign Application Priority Data

Jun. 13, 1997 [EP] European Pat. Off. ..... 97201756

[51] Int. Cl.[6] ..... G03C 1/09; G03C 1/34

[52] U.S. Cl. ..... 430/600; 430/601; 430/603; 430/605; 430/607; 430/610; 430/611; 430/613

[58] Field of Search ..... 430/603, 605, 430/607, 610, 611, 613, 600

[56] References Cited

U.S. PATENT DOCUMENTS

| | | | |
|---|---|---|---|
| 3,717,466 | 2/1973 | Florens et al. | 430/611 |
| 3,728,126 | 4/1973 | Pollet et al. | 430/611 |
| 5,217,859 | 6/1993 | Boettcher et al. | 430/569 |
| 5,219,721 | 6/1993 | Klaus et al. | 430/569 |
| 5,306,613 | 4/1994 | Yagihara et al. | 430/600 |
| 5,328,820 | 7/1994 | Klaus et al. | 430/569 |
| 5,364,754 | 11/1994 | Kim et al. | 430/569 |
| 5,391,475 | 2/1995 | Nishigaki et al. | 430/600 |

FOREIGN PATENT DOCUMENTS

| | | | |
|---|---|---|---|
| 0506009 A1 | 9/1992 | European Pat. Off. | G03C 1/09 |

*Primary Examiner*—Mark F. Huff
*Attorney, Agent, or Firm*—Breiner & Breiner

[57] ABSTRACT

A photosensitive element which comprises a support, at least one silver halide emulsion layer and at least a non-light sensitive hydrophilic colloidal layer, wherein the silver halide emulsion layer comprises a selenium compound represented by formula (1):

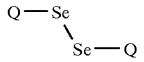

(1)

wherein:

Q represents $R^1SO_2$ or $R^2R^3P{=}X$;

each of $R^1$, $R^2$ and $R^3$ the same or different represents $OR^4$, $NR^5R^6$, $SR^7$, $SeR^8$ an alkyl group, an aryl group or a heteroaryl group;

X represents O, S or Se;

each of $R^4$, $R^5$, $R^6$, $R^7$ and $R^8$ the same or different represents hydrogen, an alkyl group, an aryl group or a heteroaryl group, or $R^5$ and $R^6$ together represents the atoms necessary to form a N-containing ring.

The invention also provides a method for the preparation of a photosensitive element as disclosed hereinbefore comprising the step of chemically sensitizing at least one of the silver halide emulsions by means of a selenium compound as defined.

10 Claims, No Drawings

PHOTOSENSITIVE IMAGE-FORMING ELEMENT WITH INCREASED SENSITIVITY-FOG-RELATIONSHIP

DESCRIPTION

FIELD OF THE INVENTION

The present invention relates to a photosensitive image-forming element, more particularly to a high sensitive photographic silver halide emulsion demonstrating an improved sensitivity-fog relationship in the presence of a selenium compound.

BACKGROUND OF THE INVENTION

In photographic industry there exists an ever lasting demand for photosensitive image-forming materials with increased sensitivity and image-quality. However both characteristics are often related which means that influencing one parameter will have its consequences for the other parameter and vice versa. This relationship can be clearly experienced in silver halide photographic materials. An increase of sensitivity of a photographic silver halide material can be realised by an increase of the mean size of the silver halide emulsion crystals of the said material. This action however results normally in a decrease of image quality. One way to solve this problem is to increase the efficiency of the electron-trapping of the latent-image in the silver halide grains. This can be realised by chemical sensitization in the presence of a chemical compound which can enhance the electron-trapping efficiency as mentioned herinbefore. This compound can be for instance a sulphur salt, a gold salt or a combination of both. In recent years chemical sensitization in the presence of a labile selenium compound is increasingly used. Examples of compounds which were suggested for use in order to get an increased sensitivity were substituted selenourea (as described e.g. in EP-A 0 280 031, EP-A 0 458 278), selenoethers (e.g. in JP-A 2-132434, JP-A 4-271341, JP-A 6-175258, U.S. Pat. No. 5,532,120), diselenides (e.g. in EP-A 0 703 492), selenoesters (e.g. in U.S. Pat. No. 5,306,613), selenoketones (e.g. in EP-A 0 476 345), phosphineselenides (e.g. in EP-A 0 506 009) and various others. However selenium sensitization easily causes fog as a result of the depth of the electron trap of the formed sensitivity speck which is larger than the depth of the sensitivity speck created by sulphur sensitization. At the same time the stability and the gradation of a selenium sensitized emulsion decrease if no precautions are taken. Special progress was announced by Yagihara M. in EP-A 0 585 787, describing chemical sensitization with seleno- or other chalcogenic compounds like $R_1CO—Se—X—COR_2$ or $(R_3CO—Se)_nMP$, where $R_1$, $R_2$, $R_3$ equals alkyl, aryl or heterocycle; X equals S, Se or Te; P equals a tri-alkyl- or tri-arylphosphonide; M equals a metal and n equals 1 or 2. Most of the patents dedicated to selenium sensitization like the ones mentioned hereinbefore are directed to the prevention of the described disadvantages. Additionally it is further known that sulphur or selenium sensitization carried out in the presence of a gold salt causes an increase in sensitivity but at the same time enhancing fog formation too. Particulary in comparison with gold-sulphur sensitization gold-selenium sensitization causes a remarkable rise in fog. However up to now the mechanism causing most of these effects is still not fully understood and a lot of work has to be done in order to get fundamental improvements in the prevention of fogging. Accordingly there has been a strong demand for selenium compounds which can give a substantial sensitivity increase while controlling fog to an acceptable low level. Such chemical selenium sensitizers give rise to silver halide emulsions with improved sensitivity-fog relationship. All the patents mentioned hereinbefore are more or less failing in disclosing a method for realizing high sensitive silver halide emulsions with low fog level by using the therein described selenium compounds.

OBJECTS OF THE INVENTION

It is therefore a first object of the invention to provide a high sensitive photographic element with improved sensitivity-fog-relationship.

It is another object of the invention to provide a high photosensitive silver halide emulsion comprising novel chemical selenium sensitizers.

It is a further object of the invention to provide a method for chemically sensitizing a silver halide photographic emulsion with a selenium compound to make sensitive photographic material with an improved sensitivity-fog-relationship.

Further objects and advantages of the invention will become apparent from the description hereinafter.

SUMMARY OF THE INVENTION

The above mentioned objects are realised by a photosensitive element which comprises a support, at least one silver halide emulsion layer and a non-light sensitive hydrophilic colloidal layer, wherein the silver halide emulsion layer comprises a selenium compound represented by formula (1):

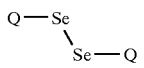

(1)

wherein:

Q represents $R^1SO_2$ or $R^2R^3P{=}X$;

each of $R^1$, $R^2$ and $R^3$ the same or different represents $OR^4$, $NR^5R^6$, $SR^7$, $SeR^8$ or an alkyl group, an aryl group or a heteroaryl group;

X represents O, S or Se;

each of $R^4$, $R^5$, $R^6$, $R^7$ and $R^8$ the same or different represents hydrogen, an alkyl group, an aryl group or a heteroaryl group, or $R^5$ and $R^6$ together represents the atoms necessary to form a N-containing ring.

The invention also provides a method for the preparation of a photosensitive element as described hereinbefore comprising the step of chemically sensitizing at least one of the silver halide emulsions by means of a selenium compound according to formula (1) and more preferably in the presence of a silver halide solvent at a pH-value situated between 3 and 10, a pAg-value between 6 and 11 and a temperature in the range of from 40° C. up to 95° C.

Preferred embodiments of the invention are disclosed in the dependent claims.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The present invention as described in the foregoing summary will now be explained in detail starting with an illustration of the compounds of the present invention satisfying formula (1):

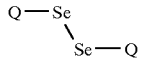

(1)

wherein:

Q represents $R^1SO_2$ or $R^2R^3P{=}X$;

each of $R^1$, $R^2$ and $R^3$ the same or different represents $OR^4$, $NR^5R^6$, $SR^7$, $SeR^8$ or an alkyl group, an aryl group or a heteroaryl group;

X represents O, S or Se;

each of $R^4$, $R^5$, $R^6$, $R^7$ and $R^8$ the same or different represents hydrogen, an alkyl group, an aryl group or a heteroaryl group, or $R^5$ and $R^6$ together represents the atoms necessary to form a N-containing ring.

A preferred group of compounds which are useful in the scope of this invention is represented by formula (2):

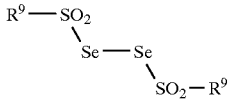

(2)

where $R^9$ is restricted to an alkyl group, an aryl group or a heteroaryl group.

Another preferred group of compounds included by the general formula (1) of this invention can be described by formula (3):

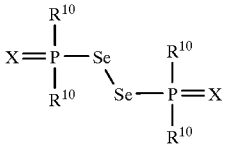

(3)

wherein:

X represents O, S or Se;

$R^{10}$ represents an alkyl group, an aryl group, a heteroaryl group or an alkoxy group.

Specific examples of selenium compounds which can be used in the photographic material of the present invention include the following diseleniumdisulphonates:

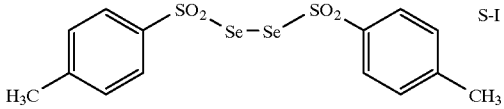

S-I

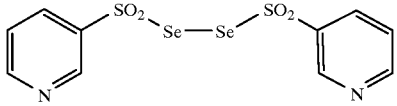

S-II

-continued

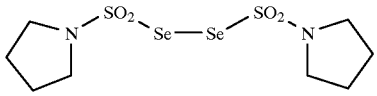

S-III

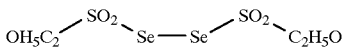

S-IV

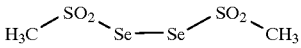

S-V

Other specific examples of selenium compounds for use according to the present invention are the following phosphoric-diselenides:

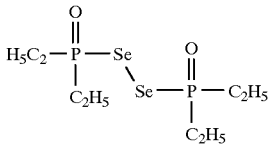

P-I

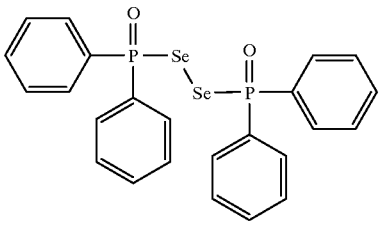

P-II

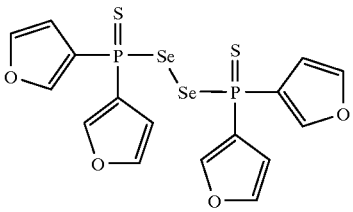

P-III

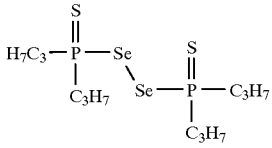

P-IV

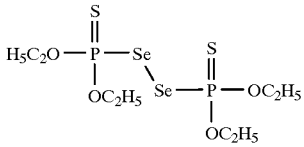

P-V

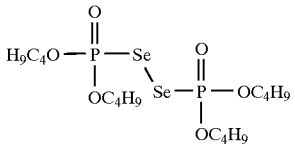

P-VI

-continued

P-VII

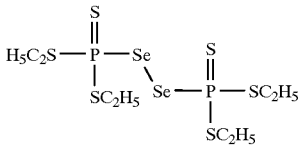

P-VIII

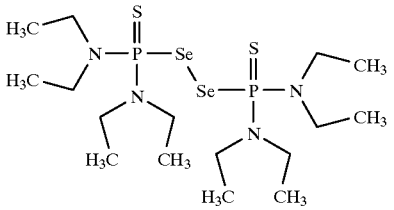

P-IX

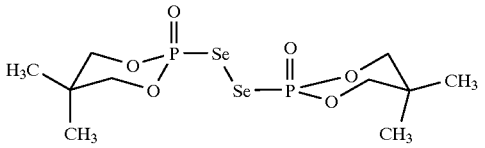

P-X

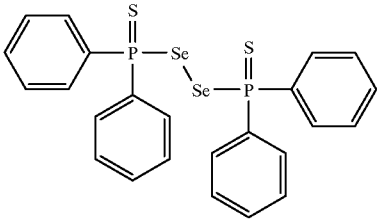

P-XI

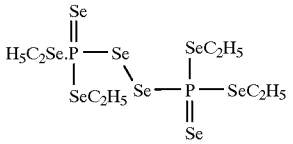

The compounds represented by general formula (1) can be synthetized according to known methods or as will be described below.

The synthesis of P-V

Scheme 1

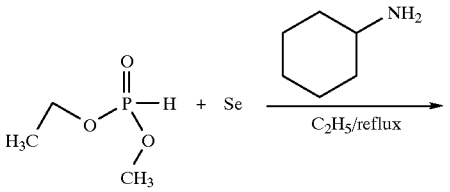

-continued

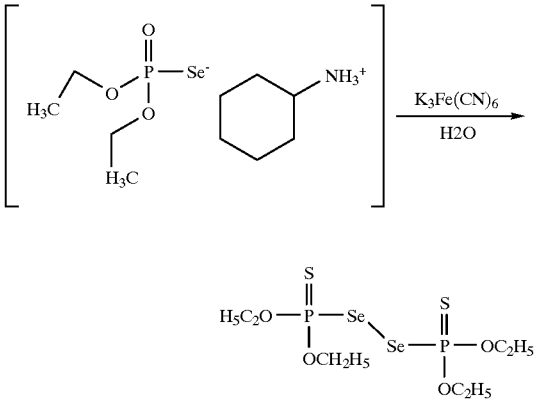

1.98 g of diethylthiophosphite was dissolved in 40 ml of ethanol. After adding 1.08 g of selenium and 1.3 g of cyclohexylamine the mixture was refluxed for 24 hours, filtered over CELITE and evapourated under reduced pressure. The yellow oily residu was dissolved in water without further purification and a solution of one equivalent of $K_3Fe(CN)_6$ in 20 ml of water was added over 30 minutes at room temperature. A red brown oil precipitates from this solution. After adding 10 ml of a 10% HCl-solution the resulting aqueous solution was extracted with methylenechloride. The methylenechloride was sequently filtered over CELITE , dried over $MgSO_4$ and evaporated under reduced pressure. The reddish brown oil was sufficiently pure to use as such.

Further examples of phosphoric-diselenides can be prepared as described in "Methoden der Organische Chemie", Phosphor-Verbindungen II, E2 (Houben-Weyl, 4-te Auflage),p.285 and references cited therein.

Synthesis of S-1

Scheme 2

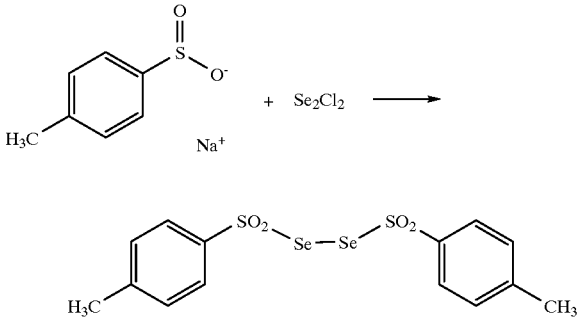

Diselenium-di(p-toluenesulfinate) was prepared as described by Foss in Acta Chemica Scandinavica Vol.6, 508–520 (1952)

The amount of the chalcogenic compound in the material of the present invention can vary depending on the type of said compound used, the type of silver halide grain, the conditions of chemical sensitization, etc. The amount of the selenium sensitizer is usually in the range of $10^{-8}$ to $10^{-3}$ but preferably in the range of $10^{-7}$ to $10^{-4}$ mole per mole of silver halide.

The introduction of the chemical selenium sensitizer can be done in various ways before starting the chemical sensitization procedure. Selenium sensitizers which are more or less water soluble can be added to the dispersion of silver halide crystals as an aqueous solution if desired mixed up with a water soluble organic solvent. Selenium sensitizers which are not water soluble can be introduced after solving the compound in a water soluble organic solvent which is normally used for the introduction of water insoluble products in a photographic silver halide emulsion. An alternative way for the introduction of an insoluble chemical chalcogenic sensitizer is using an 'oil-in-water' dispersion or if desired a dispersion as disclosed in EP-A 0 703 492 by T. Yoshida et al. In the last named patent the said compound is therefore added to the silver halide emulsion before chemical sensitization in the form of a solid partical dispersion in water.

The chemical sensitization with compounds of the present invention satisfying formula (1), which includes the compounds according to formula (2) or formula (3), is carried out by preference in the presence of a silver halide solvent like e.g. a thiocyanate salt. This can be added as a sodium, a potassium or preferably as an ammonium salt but it is not limited thereto. The thiocyanate salt can be added before, during or after the addition of said compound of the invention and before, during or after the addition of any other chemical sensitizer which can be used together with the said selenium sensitizer. The amount of the thiocyanate which is present together with the said chemical sensitizer is limited between $10^{-6}$ and $10^{-1}$ mole per mole of silver halide and preferably situated between $10^{-5}$ and $10^{-2}$ mole per mole of silver halide.

The selenium compounds of the present invention can be used in combination with other known selenium sensitizers. The selenium sensitization itself can be carried out in the presence of a sulphur compound and if desired in the presence of a noble metal (e.g. gold). The selenium sensitization can be used in combination with a reduction sensitization too.

In the noble metal sensitization a salt of a noble metal (e.g., gold, iridium, palladium, platinum) is used but gold salts are preferably used as noble metal sensitizer. Examples of gold sensitizers which are often used include chloroauric acid, goldsulfide, chloroaurate salts, aurithiocyanate and goldselenide. The amount of the noble metal sensitizer can vary between $10^{-8}$ and $10^{-2}$ mole per mole silver halide.

Sulfur sensitization can be carried out with sulphur compounds like thiosulphates, thioureas, rhodamines, etc. The sulphur sensitizer can also be used in an amount of about $10^{-8}$ to $10^{-2}$ mole per mole silver halide.

In reduction sensitization a reducing compound is used like thiourea dioxide, hydrazine derivatives, sulphinic acid, polyamine compounds, stannous chloride, borane compounds, reductones like ascorbic acid, etc. Reduction sensitization can also be carried out at a low pAg or a high pH or at both and if desired at elevated temperature. This kind of sensitization is refered to 'silver ripening'. More information can be found in Research Disclosure, Vol307, 307105 and in P. Glafkides "Chimie et Physique Photographic", P. Montel—Paris, $5^{th}$ Ed., 1987.

The method of preparing a photosensitive element according to the present invention comprises the step of chemically sensitizing at least one silver halide emulsion in the presence of the selenium compound represented by formula (1). The chemical sensitization described in the method of the present invention is further preferably carried out under conditions of pAg in the range of 6 till 11 but preferably between 7 and 10, in conditions of pH in the range of 3 to 10, preferably 4 to 8.5, while the temperature is situated in the range between 40 to 95 degrees C., preferably between 45 to 85 degrees C. There are no particular limitations to any of these conditions.

The silver halide emulsion can be prepared in various ways by conventional methods. These always start with a nucleation phase followed by a grain growth phase. In this last phase of the emulsion preparation reactants are added to the reaction vessel in the form of solutions of silver and halide salts or in the form of preformed silverhalide nuclei or fine grains which easily dissolve in the precipitation medium.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing, decreasing or fluctuating rate, if desired in combination with stepwise delivery procedures. More details about the possible ways in making a silver halide emulsion which can principally be used in this invention are summarized in Res.Discl.,38957 (September 1996) section I-C.

Beside the individual reactants neccesary to form silver halide crystals additional chemical metal salts can be added for occlusion in the crystal lattice. Such compound is replacing an appropiate of silver and halide ions in the silver halide lattice. These products or so-called dopants can be distinguished from the metal complexes which are added just before coating as an additive by EPR- or ENDOR-technique. These dopants can be used to modify the crystal structure or the crystal properties and can therefore be employed to influence many photographical properties like sensitivity, reciprocity failure, gradation, pressure sensitivity, fog, stability, etc. When coordination complexes or even oligomeric coordination complexes are used the different ligands bound at the central metal ion can be occluded in the crystal lattice too and in this way influence the photographic properties of the silver halide materials as well. Dopants which are introduced in emulsions of the present invention are those which can act as a permanent or as a non-permanent electron trap.

The doping procedure itself can normally be executed at any stage during the grain growth phase of the emulsion preparation. It is important to know that the dopants can also be added in an indirect way by the addition of a dispersion containing very fine soluble silver halide grains or nuclei comprising the dopant. More additional information about the introduction and the use of dopants in the emulsion crystals of this invention can be found in Research Disclosure, 38957 (September 1996), section I-D.

The photographic emulsions prepared in this way contain silver halide crystals comprising chloride, bromide or iodide alone or in combinations thereof. Other silver salts which can be incorporated in a limited amount in the silver halide lattice are silver phosphate, silver thiocyanate, silver citrate and some other silver salts. The chloride and bromide halide can be combined in all ratios to form a silverchlorobromide salt. Iodide ions however can be coprecipitated with chloride and/or bromide ions in forming a iodohalide with an iodide amount which depends on the saturation limit of iodide in the lattice with the given halide composition; this means up to a maximum amount of about 40 mole percent in silver iodobromide and up to at most 13 mole procent in silver iodochloride both based on silver.

The composition of the halide can change in the crystal in a continous or discontinous way. Emulsions containing crystals composed of various sections with different halide compositions are used for several photographic applications. So a structure with a difference in halide composition between the center and the rest of the crystal (what is called 'core-shell'-emulsion) or with more than two crystal parts differing in halide composition (called a 'band'-emulsion) may occur. The changes in halide composition can be realised by direct precipitation or in an indirect way by conversion where fine silver halide grains of a certain halide composition are dissolved in the presence of the so-called host grains forming a 'shell' or 'band' on the given grain.

The crystals formed by the methods described above have a morphology which can be tabular or non-tabular. In tabular crystals the aspect ratio (ratio of equivalent circular diameter to thickness) can vary from low (<2) over 'medium' (2 till 8) to high (>8) where specially in the case of the ultra thin tabular crystals high aspect ratios can be realised. The major faces of the formed tabular grains can have a {111} or a {100}-habitus the structure of which is (respectively) stable or has to be stabilised (for instance by a 'habitus modifying agent'). In the class of non-tabular grains there are a lot of possibilities which can be divided in the more regular shaped crystals or the crystals with a mixed crystal habit.

For certain applications it can be important to apply a well-defined amount of iodide on the crystal surface under controlled conditions in order to get reproducible sensitometric results after image-wise exposure and subsequent processing. This can be done by using an iodide releasing agent as described in EP-A 0 561 415 and in EP-A 0 563 708 and applied on emulsions before, during or after the chemically sensitization in addition to the method and the conditions of the present invention as described hereinbefore.

A hydrophilic colloid is used as a binder or a protective colloid for the emulsion or any other layer of the photographic material of the invention. Gelatin is an advantageous hydrophilic colloid. The preparation of conventional lime-treated or acid-treated gelatin has been descibed in e.g. "The Science and Technology of Gelatin", edited by A. G. Ward and A. Courts, Academic Press 1977, page 295 and further. The gelatin can also be enzyme-treated as described in Bull.Soc.Sci.Phot.Japan, Nr 16, page 30 (1966).

Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerisable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used.

Part of gelatin may further be replaced with a synthetic or natural high-molecular material.

An interesting substitute for gelatin may be silica as has been described in the published EP-A's 0 392 092, 0 517 961, 0 528 476 and 0 649 051 and 0 704 749. As has been set forth in EP-A 0 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, without however having a predictable mean crystal diameter and crystal size distribution. These problems have been overcome as has been described in EP-A 0 682 287, for the preparation of crystals rich in silver chloride, wherein clearly defined circumstances wherein such crystals can be prepared: during the precipitation stage of regular silver chloroiodide crystals amounts of silica sol and of stabilising onium compound(s), should be optimised in order to avoid uncontrolled formation and growth of aggregates.

The emulsions can be coagulated and washed after precipitation in order to remove the excess soluble salts. These procedures are together with different alternative methods like dia- or ultrafiltration and ion-exchange described in Res.Discl., 38957(September 1996), section III.

Additional gelatin or another hydrophilic colloid, suitable as a binder material can be added at a later stage of the emulsion preparation e.g. after washing, to establish optimal coating conditions and/or to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure N° 38957 (1996), Chapter II.

The silver halide emulsions of this invention which are prepared in one of the ways described hereinbefore contain crystals which have a spherical equivalent diameter (SED) of not more than 1.5 mm but preferable less than 1.0 mm. The spherical equivalent diameter (SED) of the crystal represents the diameter of the sphere which has the same volume as the average volume of the silver halide crystals of the said emulsion.

The emulsions can be surface-sensitive emulsions which form latent images primarily on the surface of the silver halide grains or they can be emulsions forming their latent-image primarily in the interior of the silver halide grain. The emulsions can further be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

In a next step the silver halide emulsions are spectrally sensitized with dyes from different classes which include polymethine dyes comprising cyanines, merocyanines, tri-, tetra- and polynuclear cyanines and merocyanines, oxanols, hemioxanols, styryls, merostyryls and so on. Sometimes more than one spectral sensitizer may be used in the case that a larger part of the spectrum has to be covered. Combinations of several spectral sensitizers are sometimes used to get supersensitization, which means that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, and so on. A good description of all the possibilities in spectral sensitization which can be important with respect to this invention are found in Res.Discl., 38957(September 1996) section V.

The photographic elements comprising the said silver halide emulsions can include various compounds which should play a certain role in the material itself or afterwards in the processing, finishing or warehousing the photographic material. These products can be stabilizers and antifoggants. The antifoggant prevents occurance of a fog while a stabilizer has a function of stabilizing the photographic property. The antifoggant and the stabilizer are used in preparation, storage or processing stage of the photographic material. The antifoging agent and the stabilizers can be azoles, mercaptopyrimidines, mercaptotriazines, azaindenes, etc. Further suitable examples are e.g. those described in Res.Discl., 38957(September 1996) section VII.

The hydrophilic colloidal layer (silver halide emulsion layer, backing layer, antihalo-layer, etc.) of the photographic material can contain an inorganic or an organic hardening agent (see Res.Discl.,38957(September 1996) section IIB), brighteners (see Res.Discl.,38957(September 1996) section VI), light absorbers and scattering materials (see Res.Discl., 38957(September 1996) section VIII), coating aids (see Res.Discl.,38957(September 1996) section IXA), antistatic agents (see Res.Discl.,38957(September 1996) section IXC), matting agents (see Res.Discl.,38957(September 1996) section IXD) and development modifiers (see Res.Discl.,38957(September 1996) section XVIII).

The photographic element may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)a-crylamides, vinyl esters, acrylonitriles, olefins, and styrenes, or copolymers of the above with acrylic acids, methacrylic acids, a-b-unsaturated dicarboxylic acids, hydroxyalkyl (meth)acry-lates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Res.Discl.,38957 (September 1996) Section VI, wherein also suitable optical brighteners are mentioned.

Spacing agents may be present of which, in general, the average particle size is comprised between 0.2 and 10 mm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophtha-late. Other suitable spacing agents have been described in U.S. Pat. No. 4,614,708.

Prior to coating any thickening agent may be used in order to regulate the viscosity of the coating solution, provided that they do not particularly affect the photographic characteristics of the silver chloroiodide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers rich in chloride before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Further suitable possibilities for hardening can be found in Res.Discl.,38957(September 1996) section IIB.

The photographic elements can be coated on a variety of supports which can be flexible or rigid. The flexible materials include plastic films and papers while the rigid materials include glass, metals, etc. The surface of the support is generally subjected to undercoating treatment (like corona discharge, irradiation with ultraviolet rays, etc) to enhance the adhesion with the silver halide emulsion layer (see Res.Discl.,38957(1996) section XV and the references cited therein). The photographic elements can be exposed to actinic radiation, specially in the visible, near-ultraviolet and near-infrared region of the spectrum, to form a latent image (see Res.Discl., 38957(1996) section XVI).

Various exposure means can be employed for exposure of the photographic material of the invention. As the light source, any optional light source releasing a radiation corresponding to the sensitivity wavelength of the photographic material can be employed. Examples of the light sources generally used include natural light, incandescent lamp, halogen lamp, mercurey lamp, fluorescent lamp and all types of flash light sources. Light sources that emit light in the ultraviolet to infrared region can be also used as recording light sources. Photographic materials can for example also be exposed to gas lasers, semiconductor lasers, light emitting diodes or plasma light sources. In the same way the material can be exposed to a LCD-'light source' or to a fluorescent surface given by a phosphor stimulated with electron rays.

The latent-image formed in the silver halide crystals after exposure can be processed in order to form a visible image. Therefore various methods are known and many developing, fixing and stabilizing agents are described for the formation of photographic silver image. These know-how for processing photographic silver halide materials which principally can be used in relation with the present invention is described in Res.Discl.,176043(December 1978) sections XIX to XXIV and in Res.Discl.,38957 (1996) section XIX).

In the conventional way of processing most of the materials are developed by means of a liquid containing hydroquinone as main developing agent usually in combination with a so-called auxiliary developer. In a alternative way of processing hydroquinone is incorporated in the photographic material itself while the processing liquid is an mere alkaline solution. However it is important to realize that hydroquinone is suspect in various ways specially in an ecological and medical point of view. The present invention is also related with a more ecological way of processing where hydroquinone is at least partly replaced by ascorbic acid as developing agent. Ascorbic acid should be interpreted in a broad sense and includes ascorbic acid isomers, derivatives, salts and analogous compounds (including some reductones and reductic acid derivatives). The most preferred compounds are ascorbic acid, iso- ascorbic acid and their salts. Useful combinations of developers containing an ascorbic acid developing agent which should be preferably used in the scope of the present invention is described for many applications (in graphics, radiography, etc) in Res.Discl., 37152(March 1995)185–224.

The photographic emulsions according to the present invention can be used in various applications as described e.g. in unpublished Application EP 97/200590 (filed Mar. 1, 1996) for radiological imaging but also in multi-layered multicolor materials. These multicolor materials comprise a support and two or more silver halide emulsion layers that have different spectral sensitivities. The multi-layered color photographic material generally comprises at least one red-sensitive emulsion layer, at least one green-sensitive emulsion layer and at least one blue-sensitive emulsion layer on a support. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer in order to enhance the sensitivity.

The silver halide material can also contain different types of couplers which can be incorporated in color photographic materials. The red-sensitive emulsion layer contains generally a cyan coupler, the green-sensitive layer generally contains a magenta coupler and the blue-sensitive emulsion layer generally contains a yellow coupler. All the information which can be important for the application of the present invention in these type of materials is extensively described in Res.Discl.,38957 (September 1996) section X. More information in relation with the various color applications which belong also to the scope of the present invention, can be found in U.S. Pat. No. 5,532,120 too.

Processing to form a visible dye image for colour materials means contacting the element with a colour developing agent in order to reduce developable silver halide and to oxidize the colour developing agent which in turn normally reacts with a coupler to form a dye (see Res. Discl.,38957 (September 1996) section XX).

The invention is described hereinafter by way of the following examples.

EXAMPLES

Example 1

The example described hereinafter will clearly demonstrate the practical advantages which can be realised with the chemical selenium sensitizers of the present invention compared with a conventional sulphur-gold chemical sensitization and with another type of chemical selenium sensitizer representing the state of the art in this particular field of chemical sensitizing silver halide emulsions.

For this experiment the following three solutions were prepared for use during the precipitation:

solution (1): containing 500 grams of silver nitrate in 1500 ml of demineralized water;

solution (2): containing 129.45 grams of potassium bromide in 555 ml of demineralized water;

solution (3): containing 213.41 grams of potassium bromide and 4.88 grams of potassium iodide in 930 ml of demineralized water.

These solutions were kept at 55° C. before and during precipitation.

Preparation of Emulsion 1.

(a) Nucleation step:

The solutions (1) and (2) were introduced into a reaction vessel during 35 seconds at 26 ml per minute using the double jet technique. Said reaction vessel initially contained 2127 ml of distilled water at 51° C., 12.5 grams of potassium bromide and 6 grams of gelatin. After one minute the reaction temperature of this mixture was raised to 70° C. in 20 minutes and a solution of 47.5 grams of phtalated gelatin in 475 ml of distilled water were added. After 6 minutes the neutralisation step was started.

(b) Neutralisation step:

Solution (1) was added to the reaction vessel at a rate of 7.5 ml per minute to reach a pAg value of 8.99 (−10 mV versus a saturated Ag/AgCl reference electrode), whereafter the first growth step was started.

(c) First growth step:

A double jet precipitation was started using solutions (1) and (2) which continued for 45 minutes 44 seconds. The flow rate of solution (1) was 7.5 ml per minute at the start, linearly increasing to 14.5 ml per minute at the end of the precipitation. During this precipitation, the pAg value was kept constant at 8.99. Thereafter the second neutralisation step was started.

(d) Second neutralisation step:

Solution (1) was added to the reaction vessel at a rate of 7.5 ml per minute in order to reach a pAg value of 7.38, whereafter the precipitation further continued with a second growth step.

(e) Second growth step:

904 ml of solution (1) was injected into the reaction vessel at a rate of 7.5 ml per minute at the start, linearly increasing to 22.5 ml per minute at the end of the precipitation. The pAg was kept constant at 7.38 using solution (3) for 60 minutes and 15 seconds.

The emulsion was flocculated after addition of polystyrene sulphonic acid, acidification to a pH value of 3.4. After sedimentation the mother liquid was removed, distilled water added and remaining salts were washed out after repeating this procedure. The AgBrI-emulsion prepared in this way contained crystals which have a mean spherical diameter of 0.964 mm and a thickness of 0.22 mm.

The chemical sensitization step.

After redispersing the emulsion with demineralized water (till 120 grams of silver nitrate per 1000 grams of the emulsion) various compounds were added as described hereinafter. The emulsion was therefor first adjusted at a pH value of 5.5 and a pAg value of 8.08 (measured at 40° C.) followed by the successive addition (measured per 500 grams of silver nitrate) of:

- 5 ml of a polyoxyalkylene compound, immediately followed by
- 4 ml of a 1.03 molar solution of potassium thiocyanate, after 5 minutes followed by
- 0.2 ml of a 0.00476 molar solution of sodium thiosulphonic acid, after 5 minutes by
- 780 ml of a solution of hydro-5,5'-dichloro-3,3'-bis-(n.sulfobutyl)-9-ethyloxacarbo-cyanine hydroxide (2.5 gram per liter) as a green sensitiser and after 30 minutes
- a solution of sodiumthiosulphate (hereinafter called "hypo"), a solution of auric chloride (called "Au-cpd") and a solution of a selenium compound (called "Se-cpd) in amounts as indicated in Table 1.1;

After raising the temperature till 60° C. the emulsions were chemically sensitized for 3 hours. Triphenylselenofosfine (Ref) was used as reference selenium-compound:

Ref

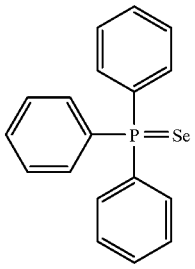

Coating of the Emulsions 1.1–1.5

After the chemical ripening periode the temperature was lowered till 38° C. while the pH was adjusted at 6.1 and the pAg at 8.87, immediately followed by the subsequent addition of an amount of a triazaindolizine sufficient to stabilize the emulsions and several wetting agents in order to coat the emulsions on a polyethylene terephthalate support. Gelatine was added till the ratio of gelatine over silver halide expressed as silver nitrate is 1.0. The resulting photographic material contained silver halide in an amount corresponding to about 2.3 grams of $AgNO_3$ per $m^2$ as indicated in Table 1.2. The hardening was realised by the addition of a bis-vinylsulfonmethane compound.

TABLE 1.1

Conditions for the chemical sensitization for the given tabular AgBrI-emulsion

| Exp Nr. | "Hypo" ($10^{-5}$ mole/mole Ag) | "Au-cpd" ($10^{-6}$ mole/mole Ag) | Used Selenium-cpd. | "Se-cpd" ($10^{-6}$ mole/mole Ag) | |
|---|---|---|---|---|---|
| 1.1 | 1.085 | 1.72 | — | — | compar. |
| 1.2 | 0.543 | 3.20 | Ref | 2.97 | compar. |
| 1.3 | 1.086 | 6.40 | Ref | 5.94 | compar. |
| 1.4 | 0.543 | 3.20 | S-I | 2.97 | invention |
| 1.5 | 1.086 | 6.40 | S-I | 5.94 | invention |

Exposure and Processing Procedure.

The samples of these coating were exposed during $10^{-2}$ sec through a stepwedge (cnst=0.15) in a EDGERTON 'EG & G'—Sensitometer with green light by using an U535-filter. The processing was carried out at 33° C. in a total processing-time of 90 sec by using G138 as developer and a diluted G334 (addition of 4 parts of demineralized water to 1 part G334) as fixer. Both developer and fixer are commercial products which are trademarket names of Agfa-Gevaert. The density which was realised after processing as a function of the light dose was measured and used to determine the following parameters:

Exp Nr. corresponds with the Exp Nr. of Table 1.1 and the data summarized;

ABS gives the absolute value of a sensitometric parameter for a given experiment number which is indicated by the corresponding heading; a decrease of this value means more sensitive;

REL gives the relative value of the sensitometric parameter indicated in the heading of the column, measured in relation with the data for experiment number 1.1; (+) or (−) means here respectively more or less sensitive e.g. (+) or (−) 0.30 means twice as sensitive or unsensitive as the emulsion of Exp Nr. 1.1.

$D_{min}$ is the fog level (expressed with an accuracy of 0.001);

$D_{max}$ is the maximum density (expressed with an accuracy of 0.01);

Sens (0.1>fog) means the sensitivity in log(It)-units which is realised at a density of 0.1 above fog level and where I is the intensity and t the periode of the exposure;

Sens (0.2>fog) means the sensitivity in log(It)-units which is realised at a density of 0.2 above fog level.

TABLE 1.2

Sensitometric results of the emulsions after chemical sensitization under different ripening conditions

| Exp Nr | ABS REL | g $AgNO_3$ (per $m^2$) | $D_{min}$ | $D_{max}$ | Sens (0.1 > fog) | Sens (0.2 > fog) | |
|---|---|---|---|---|---|---|---|
| 1.1 | ABS | 2.30 | .176 | 1.15 | 0.90 | 1.07 | comparat. |
| | REL | — | — | — | 0.00 | 0.00 | |
| 1.2 | ABS | 2.38 | .113 | 1.15 | | | comparat. |
| | REL | — | — | — | +0.19 | +0.17 | |
| 1.3 | ABS | 2.30 | .188 | 0.97 | | | comparat. |
| | REL | — | — | — | +0.05 | +0.02 | |
| 1.4 | ABS | 2.30 | .083 | 0.99 | | | invention |
| | REL | — | — | — | −0.07 | −0.13 | |

TABLE 1.2-continued

Sensitometric results of the emulsions after chemical sensitization under different ripening conditions

| Exp Nr | ABS REL | g $AgNO_3$ (per $m^2$) | $D_{min}$ | $D_{max}$ | Sens (0.1 > fog) | Sens (0.2 > fog) | |
|---|---|---|---|---|---|---|---|
| 1.5 | ABS | 2.30 | .102 | 1.06 | | | invention |
| | REL | — | — | — | +0.27 | +0.27 | |

It is clearly proved with the results of this example that the use of the diAcyldiselenides represented by formula (1) of the present invention has a very interesting potentiality for the sensitivity-fog-relationship. It can be noticed on the first place that a dramatic decrease of fog was realised by using emulsions which are chemically sensitized with the diselenides of this invention. This is shown by comparison with the results found in the materials which have a sulphur/gold-sensitized emulsion only (Exp.Nr 1.1) but also by comparison with the results realised with the materials containing a silver halide emulsion which is Au-S-sensitized in the presence of a 'state of the art' selenium compound normally used to get a high sensitive photographic material (Exp.Nr 1.2 and 1.3). In spite of the low fog level a loss of sensitivity can be experienced under certain conditions (compare Exp.Nr 1.4 with exp.Nr. 1.2) which can however fundamentally be prevented by increasing the amounts of Au- and S-sensitizer to the appropiate levels (compare Exp.Nr 1.5 with Exp.Nr 1.3)

Example 2

This example demonstrates the advantage of a silver halide emulsion comprising tabular AgBrI-crystals which have been chemically sensitized with a diacyldiselenide chemical sensitizer of the present invention over other chemical sensitizers. It also illustrates the influence of some physical and chemical parameters.

For this example three solutions were used during the precipitation:

Solution 1: 1.5 liter of an aqueous solution containing 500 grams of silver nitrate.

Solution 2: 1.5 liter of an aqueous solution containing 350 grams of potassium bromide.

Solution 3: 1.5 liter of an aqueous solution containing 341 grams of potassium bromide and 7.5 grams of potassium iodide.

Preparation of Emulsion 2.

(a) Nucleation step:

15.2ml of solutions 1 and 2 were introduced into a reaction vessel in 35 seconds using the double jet technique. Said reaction vessel initially contained 2127 ml of distilled water at 51° C., 12.5 grams of potassium bromide and 6 grams of gelatin. After one minute the reaction temperature of this mixture was raised to 70° C. in 20 minutes and a solution of 47.5 grams of phtalated gelatin in 475 ml of distilled water were added. After 6 minutes the neutralisation step was started.

(b) Neutralisation step:

Solution 1 was added to the reaction vessel at a rate of 7.5 ml per minute to reach a pAg value of 8.99 (−10 mV versus a saturated Ag/AgCl reference electrode), whereafter the first growth step was started.

(c) First growth step:

A double jet precipitation was started using solutions 1 and 2 which continued for 45 minutes 44 seconds. During this precipitation, the pAg value was kept constant at 8.99 (−10 mV). The flowing rate of solution 1 was 7.5 ml per minute at the start, linearly increasing to 14.5 ml per minute at the end of the precipitation. Thereafter the second neutralisation step was started.

(d) Second neutralisation step:

Solution 1 was added to the reaction vessel at a rate of 7.5 ml per minute in order to reach a pAg value of 7.38, whereafter the precipitation further continued with a second growth step.

(e) Second growth step:

904 ml of solution 1 was injected into the reaction vessel at a rate of 7.5 ml per minute at the start, linearly increasing to 22.5 ml per minute at the end of the precipitation. The pAg was kept constant at 7.38 using solution 3 for 60 minutes and 15 seconds.

The emulsion was flocculated after addition of polystyrene sulphonic acid, acidification to a pH value of 3.0. After sedimentation the mother liquid was removed, distilled water added and remaining salts were washed out after repeating this procedure.

The AgBrI crystals of the emulsion prepaired in this way were containing 1 mol % of iodide and had a spherical equivalent diameter (SED) of 0.93 mm while the thickness was 0.22 mm.

Chemical Sensitization of Emulsion 2.

The emulsion was redispersed and after addition of various compounds as described hereinafter chemically ripened to an optimal fog-sensitivity relationship.

After positioning the emulsion at pH value of 5.5 and at the pAg value of 8.08 (at a temperature of 40° C.) the following solutions were added successively (per 500 gram of $AgNO_3$):

4 ml of a 1.03 molar solution of potassium thiocyanate, after 10 minutes followed by 0.2 ml of a 0.00476 molar solution of sodium thiosulphonic acid, after 5 minutes by 780 ml of a solution of hydro-5,5'-dichloro-3,3'-bis-(n.sulfobutyl)-9-ethyloxacarbo-cyanine hydroxide (2.5 gram per liter) as a green sensitiser and after 30 minutes a solution of (0.00632 mole/l) sodiumthiosulphate, a solution of (0.001456 mole/l) auric chloride and a solution of a selenium compound in quantities as described in Table 2.1.

In this particular case the diselenide S-I is used as selenium compound where the amounts mentioned in the following table are given in ml of a 0.1% solution in N-methyl-pyrolidone. The absolute reference is the emulsion chemically sensitized with the sulphur and the gold compounds (see respectively "hypo" and "Au-cpd" in the table) where no selenium compound (mentioned by "Se-cpd") is present.

TABLE 2.1

Chemical sensitization conditions for the tabular AgBrI-emulsion

| Exp Nr. | "Hypo" conc. | "Se-Cpd" conc. | "Au-Cpd" conc. | Temp. ° C. | |
|---|---|---|---|---|---|
| 2.1 | 5 | 0 | 3.5 | 50 | Comparative |
| 2.2 | 2.5 | 5 | 3.5 | 50 | Invention |
| 2.3 | 2.5 | 5 | 3.5 | 55 | Invention |
| 2.4 | 2.5 | 5 | 3.5 | 60 | Invention |
| 2.5 | 2.5 | 5 | 6.5 | 50 | Invention |
| 2.6 | 2.5 | 5 | 6.5 | 55 | Invention |
| 2.7 | 2.5 | 5 | 6.5 | 60 | Invention |

Coating of Emulsion 2.

After chemical sensitization each emulsion was stabilized with 10 ml of 0.00375 mole/l 4-hydroxy-6-methyl-1,3,3a,7-tetra-azaindene and after addition of the normal coating additives the solutions were coated simultaneously together with a protective layer containing 1.1 g of gelatine per $m^2$ per side on both sides of a polyethylene terephthalate film support having a thickness of 175 mm. The resulting photographic material contained per side an amount of silver halide corresponding to 3.90 grams of $AgNO_3$ per $m^2$. Hardening of the layers was performed with a bis-vinylsulfonmethane compound.

Exposure and processing procedure.

Samples of these coatings were exposed with green light of 540 nm during 0.1 seconds using a continuous wedge and were processed during the 90 seconds cycle described below.

The processing occurred in a glutaraldehyde containing hydroquinone/1-phenyl-3-pyrazolidinone developer marketed by Agfa-Gevaert N.V. under the trade name G138. Fixation was carried out in fixer G334, also marketed by Agfa-Gevaert N.V. The processing was executed in a HT-300 processing machine (marketed by Agfa-Gevaert as well) with the following time (in seconds (sec.)) and temperature (in ° C.) characteristics:

| | | |
|---|---|---|
| loading: | 3.4 | sec. |
| developing: | 23.4 | sec./ 33° C. high or low activity developer |
| cross-over: | 3.8 | sec. |
| fixing: | 15.7 | sec./ 33° C. in fixer AGFA G334 (trade name) |
| cross-over: | 3.8 | sec. |
| rinsing: | 15.7 | sec./ 20° C. |
| drying: | 32.2 | sec. (cross-over time included) |
| total time: | 98.0 | sec. |

The density which was realised after processing as a function of the light dose was measured and used to determine the following parameters:

Exp Nr. corresponds with the Exp Nr. of Table 2.1 and the data summarized,

Fog level (with an accuracy of 0.01 density), the ABS(olute) sensitivity is given at a density of 1 above fog expressed in log(It): a decrease with a factor of 0.30 is indicative for an increase of sensitivity with a factor of 2; the REL(ative) values resulted after comparison with the sensitivity of Exp.Nr 2.1, the "REL" contrast g was calculated between densities 1.0 and 2.5 above fog and expressed relative to the g-value of Exp Nr. 2.1, the covering power (Cov.Power) was measured as a ratio of $D_{max}$ over the amount of coated silver (in grams per $m^2$)

The most significant parameters characterizing the sensitometric results are summerized in Table 2.2

From these results it can be clearly seen that the chemical selenium sensitization of the tabular AgBrI-emulsion of this experiment results in a substantial increase of sensitivity. However this can only be realised if the chemical sensitization is carried out under controlled conditions of the amount of gold sensitizer and of the temperature.

TABLE 2.2

Sensitometric results of the emulsions after chemical sensitization under different ripening conditions

| Exp Nr. | Fog $10^{-2}$ | | Sensitivity | | γ | Cov. Power | |
|---|---|---|---|---|---|---|---|
| 2.1 | ABS | 4 | ABS | 1.41 | | 0.45 | Comparative |
| | REL | 0 | REL | 0.00 | REL 1.00 | | |
| 2.2 | ABS | 7 | ABS | 1.31 | | 0.49 | Invention |
| | REL | +3 | REL | −0.10 | REL 0.88 | | |
| 2.3 | ABS | 11 | ABS | 1.32 | | 0.45 | Invention |
| | REL | +7 | REL | −0.09 | REL 0.81 | | |
| 2.4 | ABS | 12 | ABS | 1.42 | | 0.40 | Invention |
| | REL | +8 | REL | +0.01 | REL 0.62 | | |
| 2.5 | ABS | 5 | ABS | 1.41 | | 0.46 | Invention |
| | REL | +1 | REL | 0.0 | REL 1.01 | | |
| 2.6 | ABS | 5 | ABS | 1.38 | | 0.47 | Invention |
| | REL | +1 | REL | −0.03 | REL 0.93 | | |
| 2.7 | ABS | 5 | ABS | 1.34 | | 0.47 | Invention |
| | REL | +1 | REL | −0.07 | REL 0.96 | | |

Having described in detail preferred embodiments of the current invention, it will now be apparent to those skilled in the art that numerous modifications can be made therein without departing from the scope of the invention as defined in the following claims.

We claim:

1. A photosensitive element which comprises a support, at least one silver halide emulsion layer and a non-light sensitive hydrophilic colloidal layer, wherein the emulsion layer comprises a selenium compound represented by the formula (1):

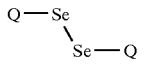

(1)

wherein:

Q represents $R^1SO_2$ or $R^2R^3P{=}X$;

each of $R^1$, $R^2$ and $R^3$ the same or different represents $OR^4$, $NR^5R^6$, $SR^7$, $SeR^8$ or an alkyl group, an aryl group or a heteroaryl group;

X represents O, S or Se;

each of $R^4$, $R^5$, $R^6$, $R^7$ and $R^8$ the same or different represents hydrogen, an alkyl group, an aryl group or a heteroaryl group, or $R^5$ and $R^6$ together represents the atoms necessary to form a N-containing ring.

2. A photosensitive element according to claim 1, wherein said selenium compound is represented by formula (2):

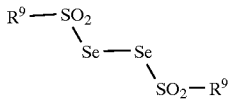

(2)

wherein $R^9$ represents an alkyl group, an aryl group or a heteroaryl group.

3. A photosensitive element according to claim 1, wherein said selenium compound is represented by formula (3):

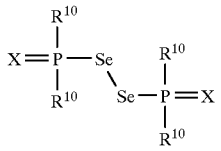

(3)

wherein:

X represents O, S or Se;

$R^{10}$ represents an alkyl group, an aryl group, a heteroaryl group or an alkoxy group.

4. A photosensitive element according to claim 1, wherein the silver halide emulsion is chemically sensitized with the selenium compound represented by formula (1) in an amount of $10^{-8}$ to $10^{-3}$ mole based on one mole of silver halide.

5. A photosensitive element according to claim 1, wherein the emulsion layer comprises a silver halide solvent in addition to the selenium compound.

6. A photosensitive element according to claim 5, wherein said silver halide solvent is a thiocyanate salt.

7. A photosensitive element according to claim 5, wherein the silver halide solvent is present in an amount of $10^{-6}$ to $10^{-1}$ mole per mole of silver halide.

8. A photosensitive element according to claim 1, wherein the silver halide emulsion layer further comprises a sulphur sensitizer, a gold sensitizer or both a sulphur and a gold sensititzer.

9. A method of preparing a photosensitive element according to claim 1, comprising the step of chemically sensitizing at least one silver halide emulsion in the presence of the selenium compound represented by formula(1):

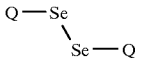

werein:

Q represents $R^1SO_2$ or $R^2R^3P{=}X$;

each of $R^1$, $R^2$ and $R^3$ the same or different represents $OR^4$, $NR^5R^6$, $SR^7$, $SeR^8$ or an alkyl group, an aryl group or a heteroaryl group;

X represents O, S or Se;

each of R4, R5, R6, R7 and R8 the same or different represents hydrogen, an alkyl group, an aryl group or a heteroaryl group, or R5 and R6 together represents the atoms necessary to form a N-containing ring.

10. A method of preparing a photosensitive element according to claim 9, wherein the step of chemically sensitizing said silver halide emulsion is performed in the presence of a silver halide solvent and in following conditions:

a pAg in the range of 6 to 11, a pH in the range of 3 to 10, a temperature in the range of from 40° C. up to 95° C.

* * * * *